US005111545A

United States Patent [19]

Krozal

[11] Patent Number: 5,111,545

[45] Date of Patent: May 12, 1992

[54] HOLSTER MOUNT

[76] Inventor: Diana J. Krozal, 6817 Lomo Alto, Apt. 10, Dallas, Tex. 75205

[21] Appl. No.: 775,038

[22] Filed: Oct. 11, 1991

[51] Int. Cl.[5] ..... A47C 31/00

[52] U.S. Cl. ..... 5/503.1; 5/658; 248/309.1

[58] Field of Search ..... 5/503, 508; 224/193, 224/253, 911; 248/220.2, 300, 309.1, 690

[56] References Cited

U.S. PATENT DOCUMENTS

| | | | |
|---|---|---|---|
| 1,844,603 | 2/1932 | Sarson | 224/911 X |
| 3,445,046 | 5/1969 | Wilson | 224/253 X |
| 4,022,361 | 5/1977 | Devlin | 224/911 X |
| 4,256,245 | 3/1981 | Serres | 224/911 X |
| 4,461,442 | 7/1984 | Keenan | 248/205.1 |
| 4,466,148 | 8/1984 | Jones | 5/503 |
| 4,483,501 | 11/1984 | Eddy | 248/205.1 |
| 4,521,930 | 6/1985 | Henson | 5/508 |
| 4,691,396 | 9/1987 | Hoffman | 5/503 |
| 4,869,449 | 9/1989 | Goodman | 5/503 X |
| 5,058,788 | 10/1991 | Newmark | 224/911 X |

*Primary Examiner*—Michael F. Trettel
*Attorney, Agent, or Firm*—Timmons & Kelly

[57] ABSTRACT

The holster mount has a bracket with a horizontal plate placed between a box springs and a bed frame. A vertical plate extends upward between the springs and the bed frame. A support plate extends upward from the vertical plate, offset by a spacer away from the box springs. A specially designed holster includes a flap and a pair of snaps that pass through a pair of holes in the support plate to connect the holster to the bracket. The snaps are spaced far enough apart to allow the holster to be mounted on a typical belt.

7 Claims, 2 Drawing Sheets

HOLSTER MOUNT

BACKGROUND OF THE INVENTION

1. Field of the Invention

This invention relates in general to handgun holsters and apparatus for mounting a holster in a convenient location. In particular, the invention relates to holsters and brackets for mounting a holster on a bed frame.

2. Description of the Prior Art

Several devices have been developed for mounting a handgun holster on a bed. These devices usually include a horizontal plate that is placed between the mattress and the bedsprings. A vertical support plate is attached to the horizontal plate, and the holster is attached to the support plate. In most cases, the holster has a belt loop that sides over an extension on the support plate. In other cases, a fastener passes through a hole in the belt loop of the holster to attach the holster to the support plate.

All of the prior art devices have one or more shortcomings. If a belt loop is slipped over an extension, it is too easy for the holster to be accidentally knocked off of the mount. If a person accidentally kicks or hits the holster during the night and knocks the holster off of the support plate, the handgun could possibly discharge.

On the other hand, if a fastener passes through the holster, the holster cannot be easily mounted and removed. The process of moving the holster and mount to a different bed may become too difficult to be worthwhile.

SUMMARY OF THE INVENTION

The object of this invention is to mount a handgun holster on a bed. The holster mount is designed to be portable, so the holster can be easily removed from the bed and can be easily carried to and mounted on another bed.

The holster mount of the invention has a horizontal plate, placed between a set of box springs and the bed frame. A vertical plate extends upward from the horizontal plate. A support plate then extends upward from the vertical plate.

The specially designed holster has a flap on one side of the holster. A pair of snaps connect the flap to the side of the holster. The two snaps can pass through a pair of holes in the support plate to connect the holster to the support plate. Alternatively, the snaps can be used to mount the holster on a belt. The snaps are spaced far enough apart to allow the belt to pass between the two snaps.

DESCRIPTION OF THE PREFERRED EMBODIMENT

Figure 1:
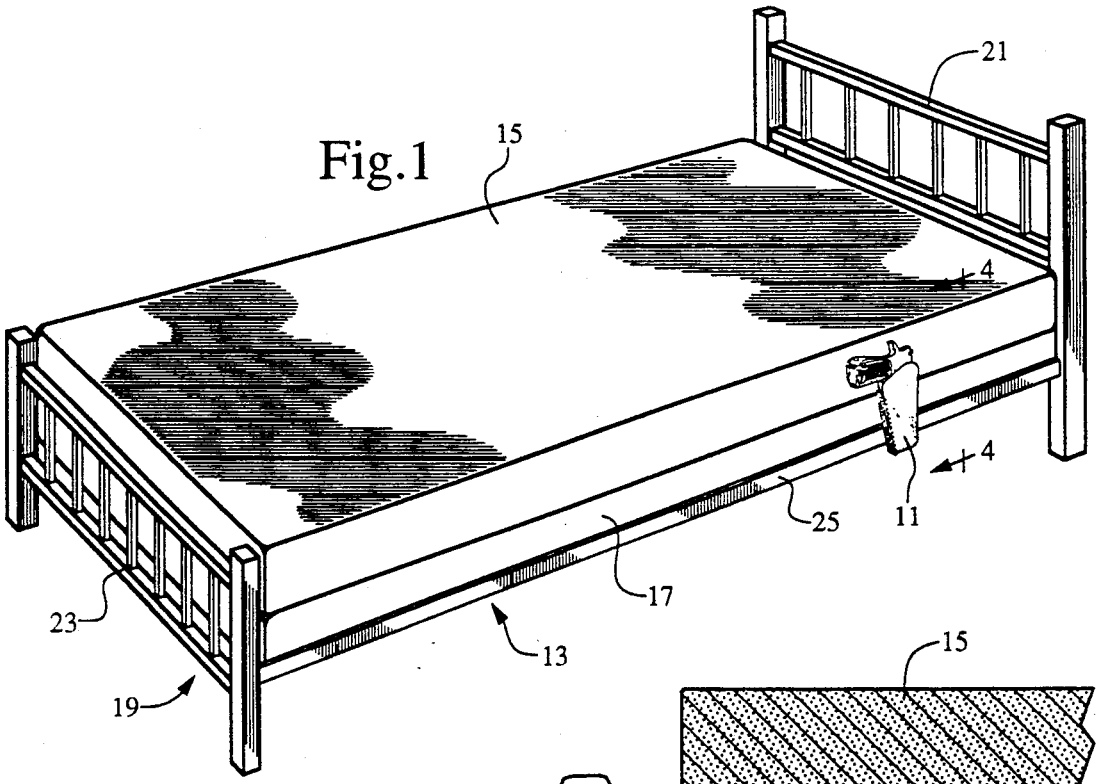
FIG. 1 is a perspective view of a handgun holster mounted on a typical bed, utilizing the holster mount of the invention.
Figure 2:
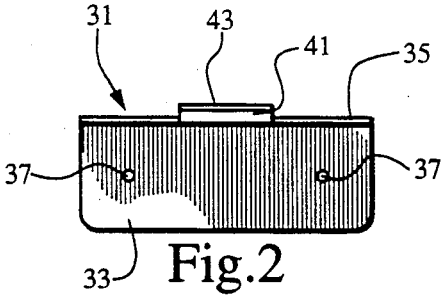
FIG. 2 is a side elevation of the bracket of the invention.
Figure 3:
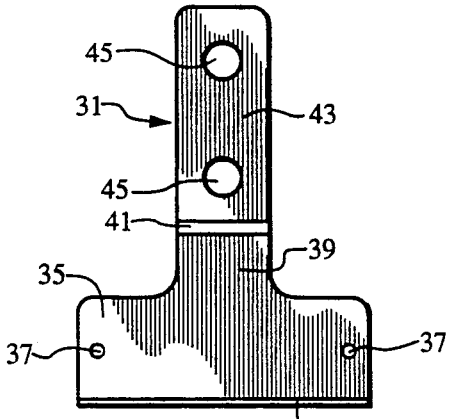
FIG. 3 is a top plan view of the bracket of the invention.

The holster mount of the invention is designed to mount a specially designed holster 11 on a typical bed 13, as shown in FIG. 1. The typical bed 13 has a mattress 15 resting on a set of box springs 17. The box springs 17 are supported by a bed frame 19. The typical bed frame 19 has a headboard 21, a footboard 23, and a pair of parallel side rails 25.

Figure 4:
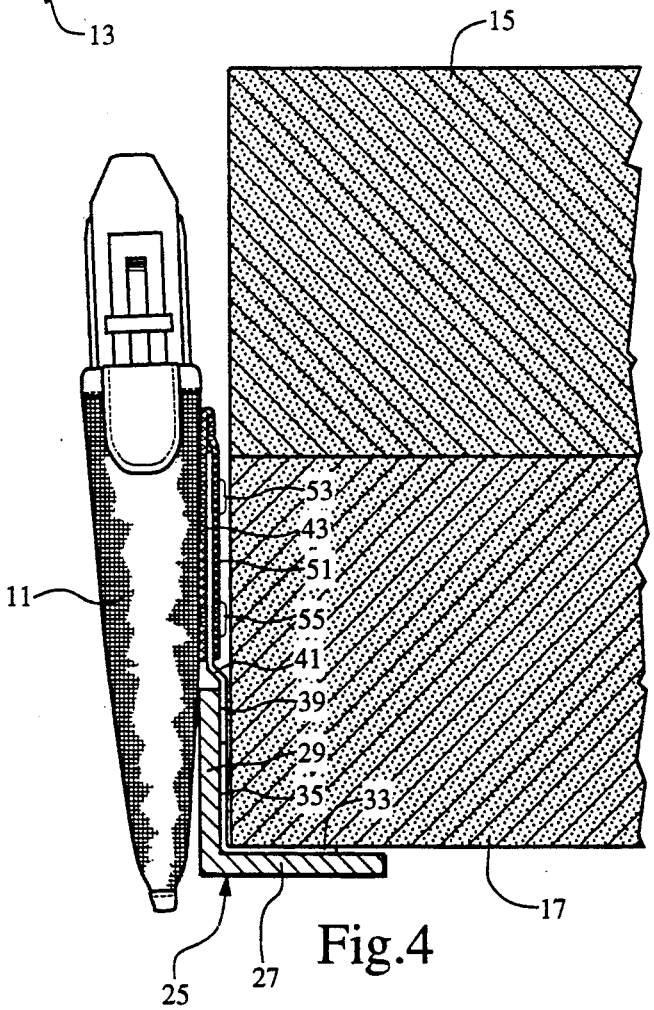
FIG. 4 is a side sectional view of the holster mount of the invention, mounting a handgun holster on a typical bed, as seen along lines 4—4 in FIG. 1.
Figure 5:
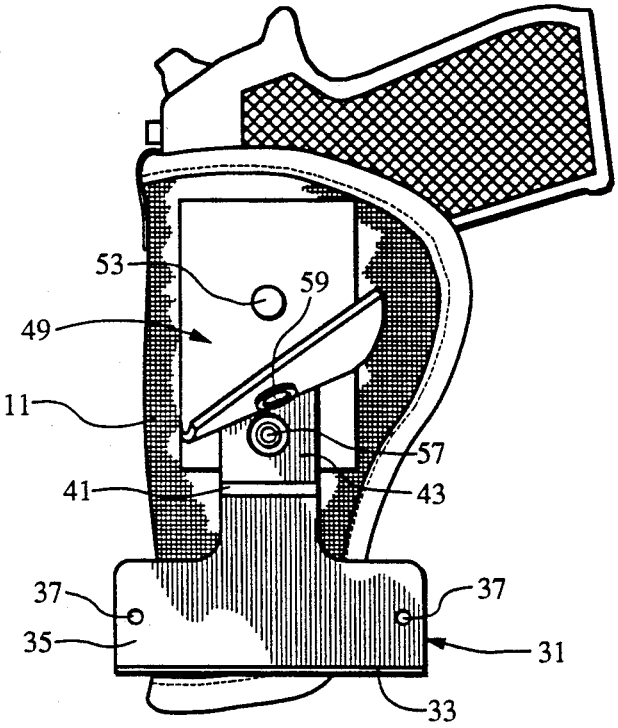
FIG. 5 is a side elevation of the holster mount of the invention.

Each side rail 25 has a horizontal bottom 27 and a vertical side 29, as shown in detail in FIG. 4. The box springs 17 usually rest on the bottoms 27 of the side rails 25 with a small space between the box springs 17 and the sides 29 of the side rails 25.

As shown in FIGS. 2–5, the holster mount of the invention includes a bracket 31. The bracket 31 is formed from a single piece of steel, and includes a horizontal plate 33 and a vertical plate 35. The horizontal plate 33 and the vertical plate 35 are generally rectangular, and are each about one and a half inches wide and about four inches long. The plates 33 and 35 are attached along one of the long sides, forming an L-shaped portion of the bracket 31. The horizontal plate 33 and the vertical plate 35 each has a pair of small nail holes 37, so that, if desired, the bracket 31 can be nailed to a support, such as a bed frame.

The bracket 31 also includes a neck section 39 extending upward from the upper edge of the vertical plate 35. The neck section 39 is centered on the vertical plate 35 and is about an inch and a quarter wide, extending upward about an inch.

A spacer 41 extends upward from the neck section 39 at a forty-five degree angle relative to the vertical plate 35. A support plate 43 then extends vertically upward from the spacer 41. The support plate 43 is thus parallel to, but offset from, the vertical plate 35. The offset is preferably about one quarter inch.

The support plate 43 is generally rectangular, being about one and a quarter inches wide and about three inches long. The support plate 43 has a pair of holes 45 having a diameter of about one half inch. The centers of the holes 45 are spaced slightly more than one and a half inches apart. The holes 45 are centered on the support plate 43, with the center of the upper hole 45 approximately three quarters of an inch down from the top of the support plate 43.

The holster mount of the invention also includes a specially designed holster 11. The holster 11 is designed to hold a handgun with little more than the handle of the gun extending out of the holster 11. In particular, the sides of the holster 11 cover the gun's trigger, so that the gun cannot be fired by bedding accidentally catching on the trigger.

A connector 49, attached to the holster 11, includes a flap 51 attached to one side of the holster 11, and a pair of couplings 53 and 57. Each coupling 53 and 57 has two parts, a first part 57 attached to the flap 51 and a second part 59 attached to the side of the holster 11. The two parts 57 and 59 of each coupling 53 and 57 are spaced apart by a distance of about one and a half inches, so that the couplings 53 and 57 can pass through the two holes 45 in the support plate 43 to connect the flap 51 to the side of the holster 11 and to connect the holster 11 to the support plate 43.

The preferred embodiment of the couplings 53 and 57 are snaps, wherein the first part 57 is a stud side and the second part 59 is a socket side. The snaps 53 and 57 pass through the holes 45 in the support plate 43 and snap together.

As shown in FIG. 4, the horizontal plate 33 of the bracket 31 is placed between the bottom of the box springs 17 and the bottom 27 of the side rail 25, so that the weight of the box springs 17 holds the bracket 31 in place. The vertical plate 35 is located in the space between the box springs 17 and the side 29 of the side rail 25.

The spacer 41 spaces the support plate 43 away from the side of the box springs 17 to leave room for the flap 51 between the support plate 43 and the box springs 17. The flap 51 is placed between the support plate 43 and the box springs 17, and the snaps 53 and 57 are snapped together through the holes 45 in the support plate 43.

Figure 6:
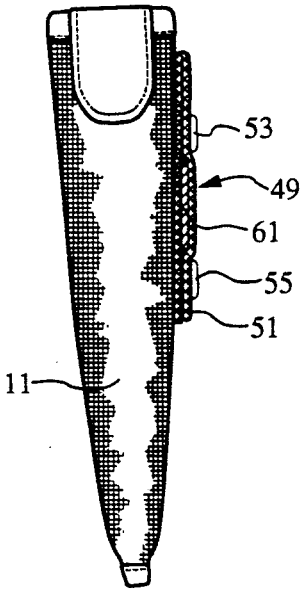
FIG. 6 is a side elevation of the holster of the invention, attached to a belt.

The distance between the snaps 53 and 57 also allows the holster to be mounted on a belt 61, as shown in FIG. 6. The snaps 53 and 57 can be snapped on either side of the belt 61 to secure the holster 11 on the belt 61.

The holster mount of the invention has several advantages over the prior art. The bracket 31 is small and compact, and thus easily portable. The holster mount of the invention can be easily removed from one bed, and packed in the luggage of a traveller. The traveller can then easily mount the holster 11 temporarily on a bed in a hotel room. The holster 11 can also be mounted an a typical belt 61. The use of the weight of the box springs 17, rather than the mattress 15, to support the bracket 31 gives the mount increased stability and safety.

The invention has been shown in only one embodiment. It should be apparent to those skilled in the art that the invention is not so limited, but is susceptible to various changes and modifications without departing from the spirit of the invention.

I claim:

1. A holster mount for mounting a holster on a bed, comprising:

a horizontal plate for placement between a horizontal portion of a bed frame and a bottom surface of a set of box springs;

a vertical plate attached to the horizontal plate for placement between a vertical portion of the bed frame and a vertical side of the set of box springs;

a support plate extending upward from the vertical plate; and a connector attached to the holster and passing through a hole completely through the support plate for connecting the holster to the support plate.

2. A holster mount as recited in claim 1, further comprising a spacer between the vertical plate and the support plate for spacing the support plate away from the vertical side of the set of box springs.

3. A holster mount for mounting a holster on a bed, comprising:

a horizontal plate for placement between a horizontal portion of a bed frame and a bottom surface of a set of box springs;

a vertical plate attached to the horizontal plate for placement between a vertical portion of the bed frame and a vertical side of the set of box springs;

a support plate extending upward from the vertical plate; and a connector attached to the holster and passing through a hole in the support plate for connecting the holster to the support plate, wherein the connector includes a snap passing through the hole in the support plate.

4. A holster mount as recited in claim 3, wherein the connector includes a second snap passing through a second hole in the support plate.

5. A holster mount as recited in claim 4, wherein the snaps are spaced apart a sufficient distance to allow the connector to be removed from the support plate and connected to a belt, wherein the belt passes between the two snaps.

6. A holster mount for mounting a holster on a bed, comprising:

a horizontal plate for placement between a horizontal portion of a bed frame and a bottom surface of a set of box springs;

a vertical plate attached to the horizontal plate for placement between a vertical portion of the bed frame and a vertical side of the set of box springs;

a support plate extending upward from the vertical plate;

a flap attached to one side of the holster; and a coupling having two parts, the first part being attached to the side of the holster and the second part being attached to the flap, wherein the coupling passes through the hole in the support plate to connect the holster to the support plate.

7. A holster mount as recited in claim 6, wherein the coupling is a snap having a stud side and a socket side, the stud side being connected to the side of the holster and the socket side being connected to the flap in positions to pass through the hole in the support plate to connect the flap to the side of the holster and to connect the holster to the support plate.

* * * * *